US012644342B1

(12) United States Patent
Lin et al.

(10) Patent No.: US 12,644,342 B1
(45) Date of Patent: Jun. 2, 2026

(54) THREADED COUPLING FOR WELL SYSTEM

(71) Applicant: Schlumberger Technology Corporation, Sugar Land, TX (US)

(72) Inventors: Chijie Lin, Rosharon, TX (US); David Gomez Ramirez, Rosharon, TX (US); Travis Hohenberger, Rosharon, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 19/169,216

(22) Filed: Apr. 3, 2025

(51) Int. Cl.
*E21B 17/042* (2006.01)

(52) U.S. Cl.
CPC ..... *E21B 17/042* (2013.01)

(58) Field of Classification Search
CPC ..... F16L 15/00; F16L 15/001; F16L 15/003; F16L 15/006; F16L 15/008; F16L 15/04; E21B 17/042; E21B 17/0426
See application file for complete search history.

(56) References Cited

U.S. PATENT DOCUMENTS 6,056,324 A * 5/2000 Reimert ..... E21B 19/16 29/446
2002/0017788 A1* 2/2002 Krug ..... E21B 17/042 285/333

* cited by examiner

*Primary Examiner* — Aaron M Dunwoody
(74) *Attorney, Agent, or Firm* — Kyle R. Miiller

(57) ABSTRACT

A sealed coupling for connecting a first section and a second section of a well system is provided. The well system extends along an axis. The sealed coupling includes a first threaded portion, a second threaded portion, and a sealing nib. The first threaded portion is positioned on the first section. The second threaded portion is positioned on the second section. The second threaded portion engages the first threaded portion. The sealing nib is positioned on one of the first section and the second section. The sealing nib protrudes in a radial direction relative to the axis to engage a surface of the other of the first section and the second section.

14 Claims, 10 Drawing Sheets

THREADED COUPLING FOR WELL SYSTEM

CROSS-REFERENCES TO RELATED APPLICATIONS

Not applicable.

BACKGROUND

Sectional tubing (e.g., pipes, hollow shafts, drains, supply lines, etc.) may be used to convey fluids. Often, tubing sections are connected to one another to form a pipeline. These tubing sections frequently include receptive and/or insertable connecting features. Thus, when assembled, the tubing sections partially overlap one another. Further, the connecting features often permit torque transmission along the assembled tubing sections.

SUMMARY

Some embodiments provide a sealed coupling for connecting a first section and a second section of a well system extending along an axis. The sealed coupling includes a first threaded portion, a second threaded portion, and a sealing nib. The first threaded portion is positioned on the first section. The second threaded portion is positioned on the second section. The second threaded portion engages the first threaded portion. The sealing nib is positioned on one of the first section and the second section. The sealing nib is configured to protrude in a radial direction relative to the axis to engage a surface of the other of the first section and the second section.

In some embodiments, the sealed coupling also includes a support nib positioned on the one of the first section and the second section, the support nib configured to protrude in the radial direction relative to the axis to engage a surface of the other of the first section and the second section.

In some embodiments, the sealing nib extends radially further than the support nib.

In some embodiments, the sealing nib is located between the support nib and an end of the one of the first section and the second section.

In some embodiments, the one of the first section and the second section includes a taper collar connected to a support collar and a tip collar.

In some embodiments, the support collar has a wall thickness that is greater than a wall thickness of the tip collar.

In some embodiments, the taper collar is inwardly partially conical.

In some embodiments, the sealing nib is configured to interferingly and sealably fit into a compression collar of the other of the first section and the second section, wherein the one of the first section and the second section bends inwardly under compression from the compression collar, wherein the first threaded portion terminates at an inner shoulder and the inner shoulder abuts the compression collar.

In some embodiments, the sealing nib is configured to interferingly and sealably fit into a compression collar of the other of the first section and the second section, wherein the compression collar has an inner diameter, a portion of the one of the first section and the second section adjacent the sealing nib has an outer diameter, and the outer diameter is smaller than the inner diameter.

In some embodiments, the sealed coupling further includes a support nib, wherein the sealing nib is configured to interferingly and sealably fit into a compression collar of the other of the first section and the second section, wherein the compression collar has an inner diameter, and wherein the sealing nib has a first outer diameter, the support nib has a second outer diameter, and the inner diameter is smaller than the first outer diameter.

In some embodiments, the first section expands the second section in a radially outward direction.

In some embodiments, at least one of the first section, the second section, and the sealing nib has a lead-in feature.

Some embodiments provide a casing section for a well system. The casing section includes a body portion, a first threaded portion, and a sealing nib. The body portion includes a first end and a second end, and a longitudinal axis extends between the first end and the second end. The first threaded portion is positioned proximate the first end, and the first threaded portion is configured to engage a second threaded portion of a separate casing section. The sealing nib is positioned between the first threaded portion and the first end. The sealing nib is configured to protrude in a radial direction relative to the longitudinal axis to engage a surface of the separate casing section.

In some embodiments, the casing section further includes a support nib configured to protrude in the radial direction relative to the axis to engage the surface of the separate casing section, wherein the sealing nib is located between the support nib and the first end.

In some embodiments, the sealing nib extends radially further than the support nib.

In some embodiments, the sealing nib is configured to interferingly and sealably fit into a compression collar of the separate casing section, wherein the first end bends inwardly under compression from the compression collar.

Some embodiments provide a well system including a first tube section and a second tube section. The first tube section extends along a longitudinal axis and includes a first end, a second end, a first threaded portion positioned proximate the first end, and a sealing nib positioned proximate the first end. The sealing nib protrudes radially outwardly relative to the longitudinal axis. The second tube section is coupled to the first tube section and includes a first end, a second end, and a collar positioned proximate the second end of the second tube section, the collar engaging the sealing nib in an interference fit.

In some embodiments, the first tube section further includes a support nib protruding radially outwardly relative to the longitudinal axis, the collar engaging the support nib, wherein the sealing nib is located between the support nib and the first end of the first tube section.

In some embodiments, the sealing nib extends radially further than the support nib.

In some embodiments, the first threaded portion terminates at an inner shoulder and the inner shoulder abuts an end of the compression collar.

BRIEF DESCRIPTION OF THE DRAWINGS

The accompanying drawings, which are incorporated in and form a part of this specification, illustrate embodiments of the disclosure and, together with the description, serve to explain the principles of embodiments of the disclosure.

DETAILED DESCRIPTION

Figure 1:
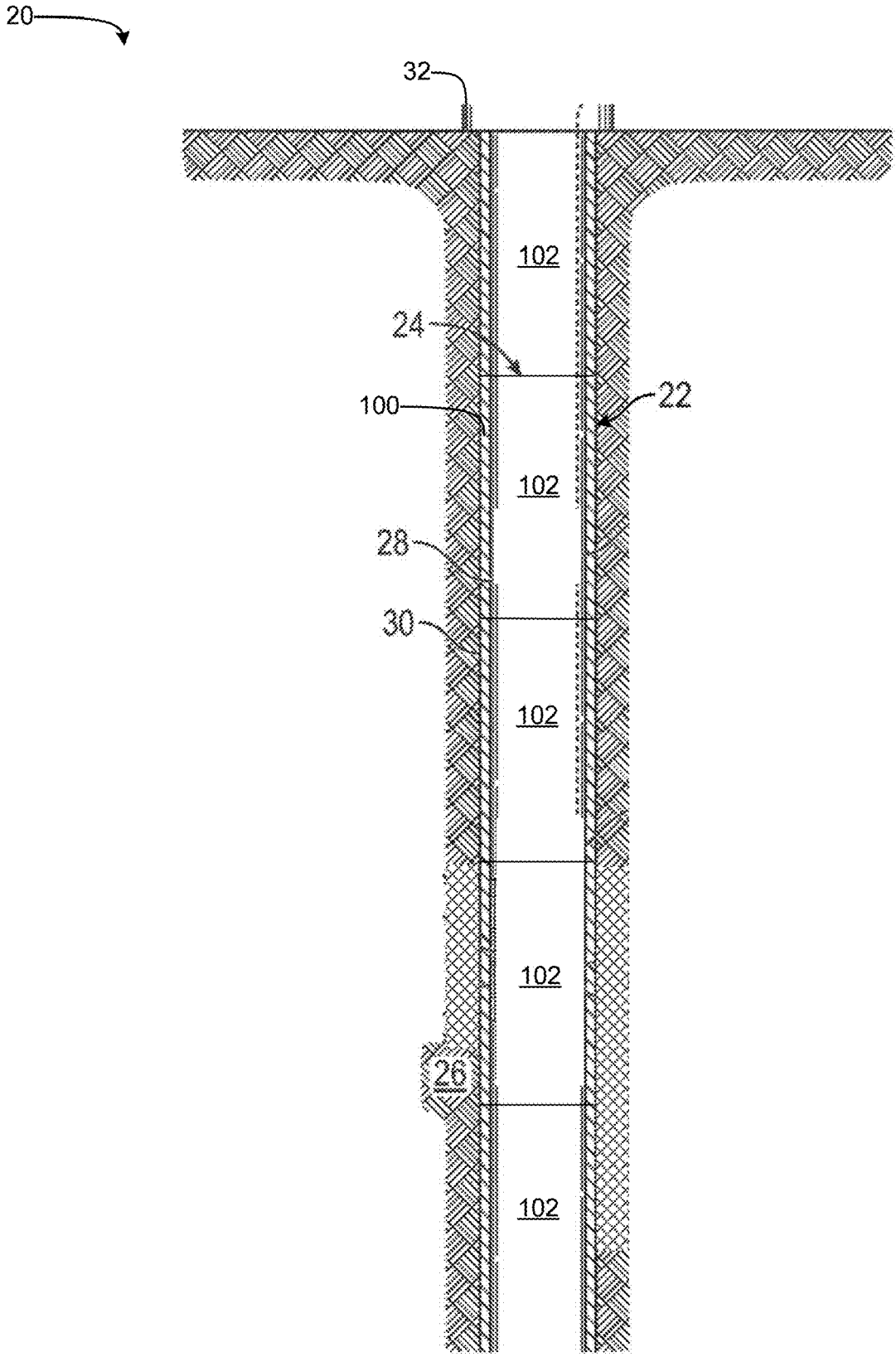
FIG. 1 is a cross-sectional view of a well system.

Various modifications to the illustrated embodiments will be readily apparent to those skilled in the art, and the generic principles herein can be applied to other embodiments and applications. Thus, it is to be understood that the disclosure is not limited in its application to the details of the configuration and arrangement of components set forth in the following description or illustrated in the accompanying drawings. The disclosure is capable of being practiced or of being carried out in various ways and is to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the disclosure. Skilled artisans will recognize the examples provided herein have many useful alternatives and fall within the scope of the disclosure.

Before any embodiments are explained in detail, it is to be understood that the disclosure is not limited in its application to the details of construction and the arrangement of components set forth in the following description or illustrated in the attached drawings. The disclosure is capable of other embodiments and of being practiced or of being carried out in various ways. Also, it is to be understood that the phraseology and terminology used herein are for the purpose of description and should not be regarded as limiting. For example, the use of "including," "comprising," or "having" and variations thereof herein is meant to encompass the items listed thereafter and equivalents thereof as well as additional items.

As used herein, unless otherwise specified or limited, the terms "mounted," "connected," "supported," and "coupled" and variations thereof are used broadly and encompass both direct and indirect mountings, connections, supports, and couplings. Further, unless otherwise specified or limited, "connected" and "coupled" are not restricted to physical or mechanical connections or couplings.

As used herein, unless otherwise specified or limited, "at least one of A, B, and C," and similar other phrases, are meant to indicate A, or B, or C, or any combination of A, B, and/or C. As such, this phrase, and similar other phrases can include single or multiple instances of A, B, and/or C, and, in the case that any of A, B, and/or C indicates a category of elements, single or multiple instances of any of the elements of the categories A, B, and/or C.

Referring generally to FIG. 1, an example well system 20 is illustrated. By way of example, a casing 22 may be disposed along a wellbore 24 drilled into a subterranean formation 26. In some well applications, the well casing 22 is metallic. The casing 22 has an interior surface 28 and an exterior surface 30. The casing 22 includes a wellhead 32 and a tube assembly 100 includes a plurality of tube sections 102 connected to one another. The tube assembly 100 may include any number of tube sections 102, depending on the depth of the wellbore 24. In some embodiments, the tube sections 102, and thus the tube assembly 100, are substantially circular in cross-section. Each tube section 102 includes substantially identical connecting features, as will be explained in greater detail below. In some embodiments, the tube sections 102 are substantially identical to one another. In some embodiments, the tube sections 102 vary in length and/or other features (e.g., external brackets, internal baffles, external grips, etc.) along the tube sections 102.

Figure 2:
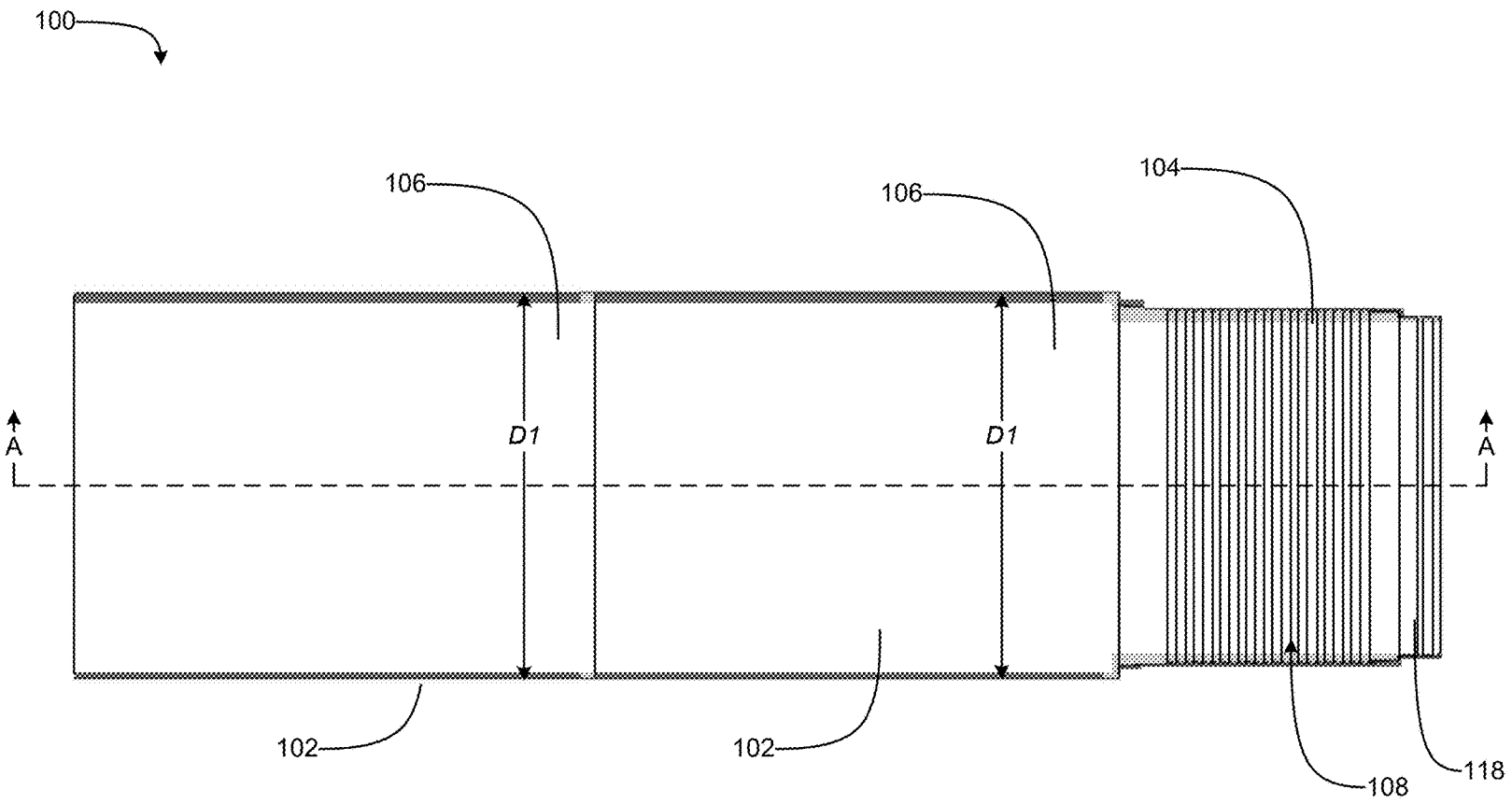
FIG. 2 is a side view of a tube assembly of the well system of FIG. 1, according to an embodiment.

FIG. 2 is an enlarged view of a portion of the tube assembly 100 illustrating two example neighboring tube sections 102 connected to one another. Each tube section 102 includes an inner connector 104 positioned adjacent one end of a body portion 106. The inner connector 104 includes outer threads 108. Further, each tube section 102 may define a first outer width or first outer diameter D1 along the body portion 106.

Figure 3:
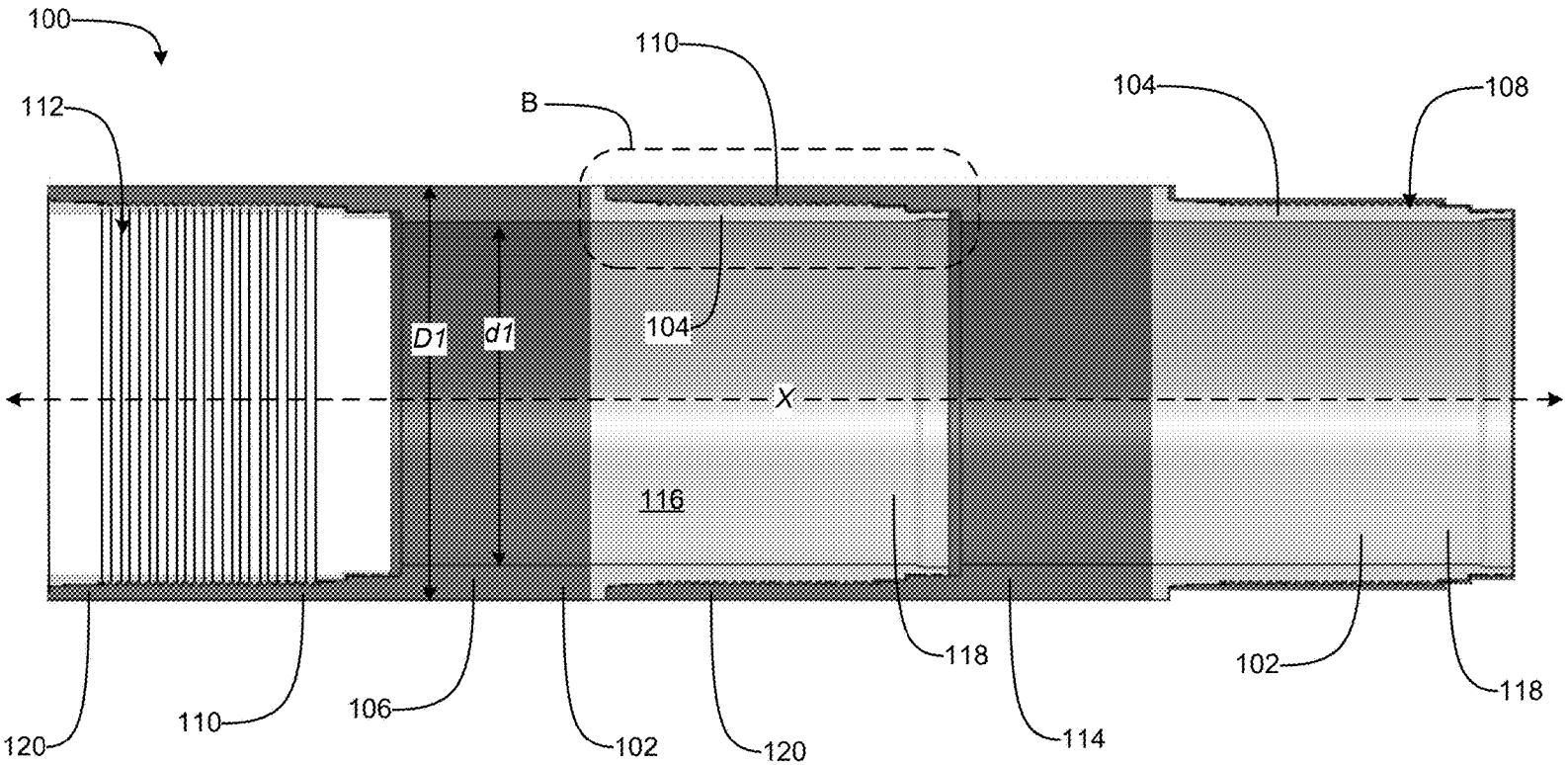
FIG. 3 is a cross-sectional view of the tube assembly of FIG. 2 taken along line A-A of FIG. 2.

Referring to FIG. 3, each tube section 102, and thus the tube assembly 100, extends along an axis X. Each tube section 102 includes an outer connector 110 positioned adjacent another end of the body portion 106. In the illustrated embodiment, the outer connector 110 includes inner threads 112 and engages the inner connector 104. Thus, the adjacent tube sections 102 are threadably connectable with one another. Further, the adjacent tube sections 102 are threadably removable from one another.

Remaining with FIG. 3, more specifically, the inner connector 104 is threadably received by the neighboring outer connector 110 of adjacent tube sections 102. Each tube section 102 may include a generally cylindrical wall 114, and a thickness of the wall may vary along a length of the inner connector 104, the body portion 106, and the outer connector 110. Thus, the cylindrical wall 114 forms the features of the inner connector 104, the body portion 106, and the outer connector 110. Each tube section 102 may define a first inner width or first inner diameter d1 along the body portion 106. Further, each tube section 102, and thus the tube assembly 100, provides a passageway 116 through which fluids may flow.

Referring again to FIG. 3, rephrased, each tube section 102 has a first end 118 and a second end 120. The inner connector 104 terminates at the first end 118. Similarly, the outer connector 110 terminates at the second end 120. When neighboring tube sections 102 are connected, the first end 118 of one tube section 102 is received by the second end 120 of an adjacent tube section 102. More precisely, the inner connector 104 of one tube section 102 is enveloped by the outer connector 110 of the neighboring tube section 102.

Figure 4:
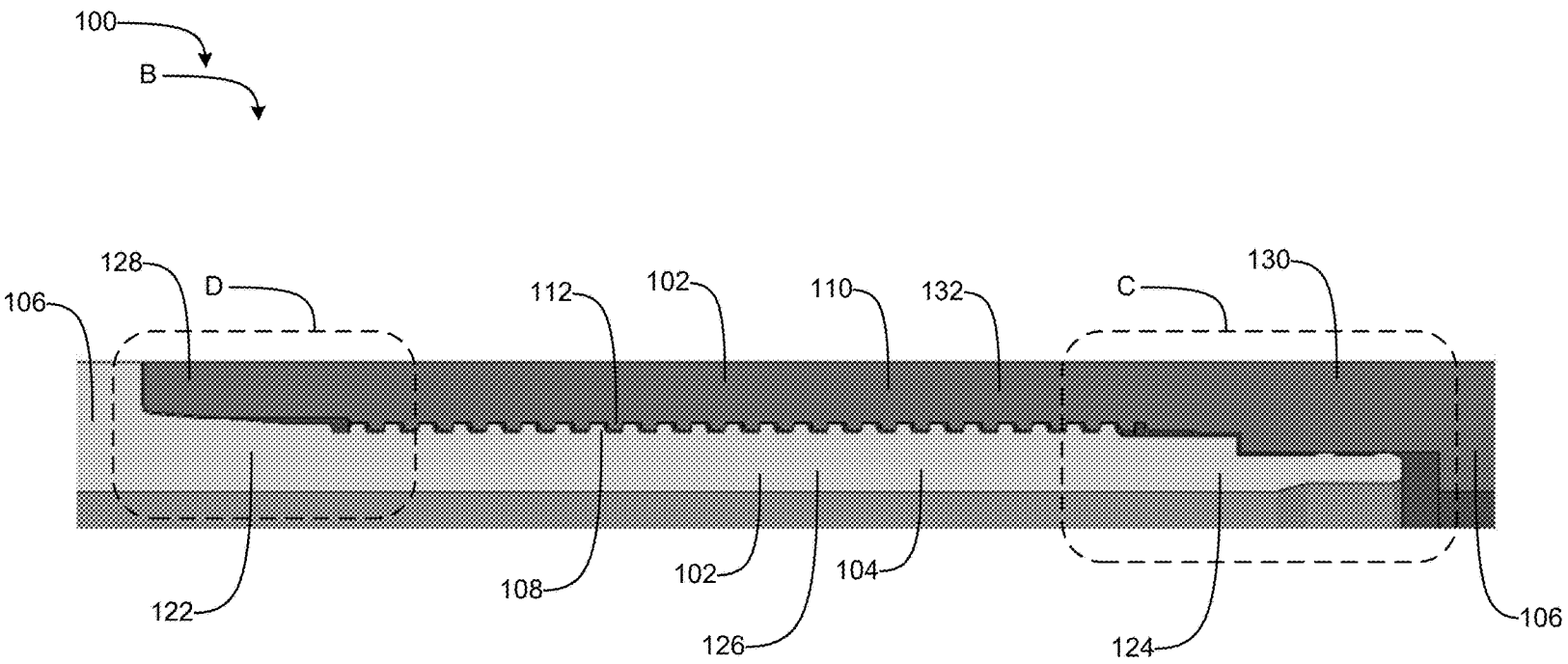
FIG. 4 is an enlarged cross-sectional view of the tube assembly of FIG. 2 taken from region B of FIG. 3.

Referring to FIG. 4, the inner connector 104 has a first inner sealing region 122 and a second inner sealing region 124 extending from an inner threaded region 126. The first inner sealing region 122 is connected to the body portion 106. Similarly, the outer connector 110 has a first outer sealing region 128 and a second outer sealing region 130 extending from an outer threaded region 132. The second outer sealing region 130 is connected to the body portion 106. In operation, the first inner sealing region 122 of one tube section 102 sealably engages the first outer sealing region 128 of an adjacent tube section 102. Meanwhile, in operation, the second inner sealing region 124 sealably engages the second outer sealing region 130. In some embodiments, these sealing operations occur substantially simultaneously. Additionally, in operation, the inner threaded region 126 is threadably received by the outer threaded region 132. Further, the tube sections 102 sealably and removably engage with one another. It should be appreciated that sealing engagement between the tube sections 102 may be reproduced should the tube sections 102 be disassembled and reassembled. Thus, the tube sections 102 are reusable.

Figure 5:
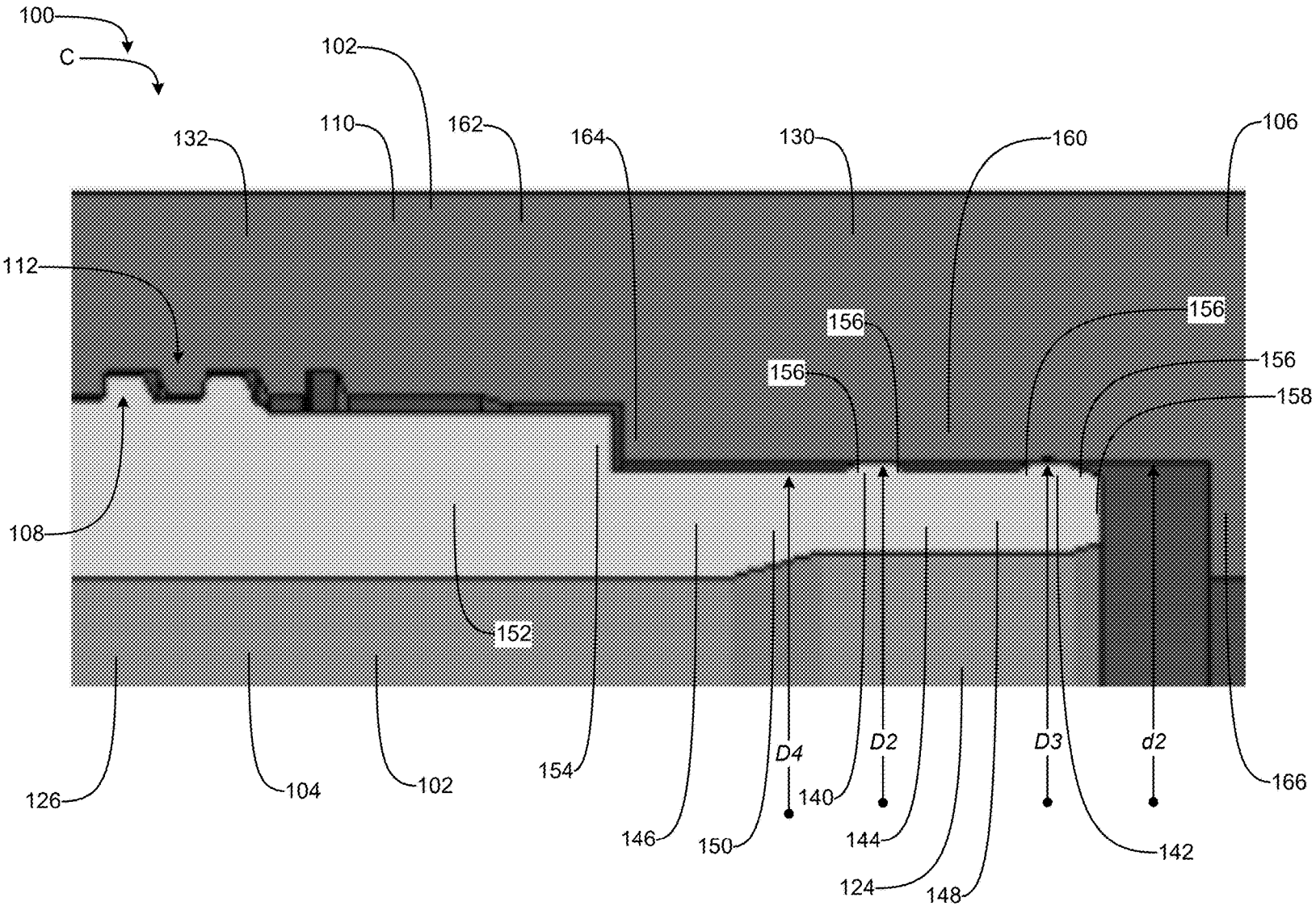
FIG. 5 is an enlarged cross-sectional view of the tube assembly of FIG. 2 taken from region C of FIG. 4.

Looking at FIG. 5, the second inner sealing region 124 includes a support nib 140 and a sealing nib 142 extending radially outwardly from a pin 144. The support nib 140 and the sealing nib 142 respectively define a second outer diameter D2 and a third outer diameter D3. The third outer diameter D3 is greater than the second outer diameter D2. Thus, the sealing nib 142 extends further radially outwardly from the pin 144 than the support nib 140. Additionally, the pin 144 defines a fourth outer diameter D4. More specifically, the pin 144 includes a support collar 146 and a tip collar 148 extending axially from a taper collar 150. The support collar 146 extends axially from an inner shank 152 of the inner threaded region 126. The support collar 146 is thinner in wall thickness than the inner shank 152 and thus forms a first inner shoulder 154 with the inner shank 152. Additionally, the outer threads 108 extend radially outwardly from the inner shank 152. The tip collar 148 is thinner in wall thickness than the support collar 146. The support nib 140, the sealing nib 142, and/or the tip collar 148, may include lead-in features 156 (e.g., a chamfer, a radius, a round-over, etc.). In some embodiments, the tip collar 148 is inwardly chamfered and/or radiused. The taper collar 150 varies in wall thickness and at least a portion of the taper collar 150 may be inwardly conical. Thus, the taper collar 150 transitionally connects the support collar 146 to the tip collar 148. Additionally, the sealing nib 142 is located at and an end 158 of the pin 144 and the support nib 140 is located medially along the pin 144.

Remaining with FIG. 5, the second outer sealing region 130 includes a compression collar 160 connected axially to the body portion 106 and an outer shank 162 of the outer threaded region 132. The compression collar 160 may have a greater wall thickness than the outer shank 162 and provide a first outer shoulder 164 with the outer shank 162. In some embodiments, the first outer shoulder 164 is chamfered, radiused, and/or otherwise eased to receive the sealing nib 142. Further, the compression collar 160 may have a wall thickness that is less than the body portion 106 and provide a second outer shoulder 166 with the body portion 106. The inner threads 112 extend radially inwardly from the outer shank 162. When the tube assembly 100 is assembled, the outer threads 108 and the inner threads 112 threadably engage and tighten against one another. In some instances, when the tube assembly 100 is assembled, the first inner shoulder 154 abuts the first outer shoulder 164. Further, the compression collar 160 defines a second inner diameter d2. The third outer diameter D3 is greater than the second inner diameter d2. Thus, when the tube assembly 100 is assembled, the sealing nib 142 interferingly and sealably fits into the compression collar 160. Additionally, in some instances, the second outer diameter D2 is greater than the second inner diameter d2. Thus, in such instances, when the tube assembly 100 is assembled, the support nib 140 interferingly and sealably fits into the compression collar 160. Further, the fourth outer diameter D4 is smaller than the second inner diameter d2. In some embodiments, the pin 144 slidably engages the compression collar 160. Moreover, the compression collar 160 compresses the second inner sealing region 124. Thus, the pin 144 bends radially inwardly under compression from the compression collar 160.

Figure 6:
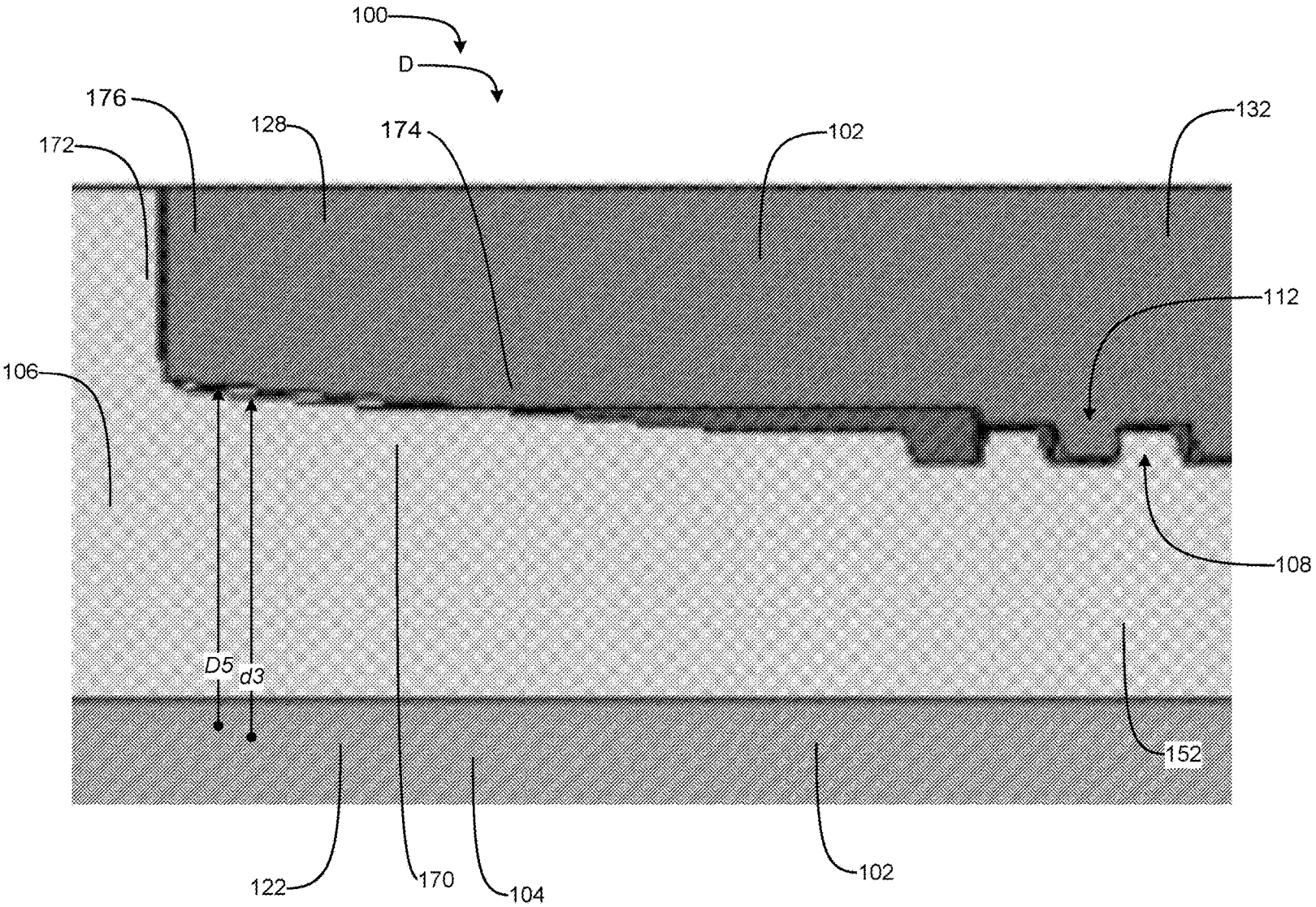
FIG. 6 is an enlarged cross-sectional view of the tube assembly of FIG. 2 taken from region D of FIG. 4.

Turning to FIG. 6, the first inner sealing region 122 is connected to the body portion 106 and the inner shank 152. The first inner sealing region 122 varies in wall thickness to form an insert ramp 170. In some embodiments, the insert ramp 170 is arcuate and/or humped. More specifically, the first inner sealing region 122 may have a greater wall thickness at a position proximate the body portion 106 than a wall thickness at a position proximate the inner shank 152. Additionally, the first inner sealing region 122 may have a wall thickness that is less than the body portion 106 and provide a second inner shoulder 172 with the body portion 106. Further, the first outer sealing region 128 includes a receiving ramp 174 and a second outer shoulder 176. In some embodiments, the receiving ramp 174 is arcuate and/or humped. In operation, as the tube assembly 100 is assembled, the receiving ramp 174 receives the insert ramp 170. A third inner diameter d3 of the receiving ramp 174 is smaller than a fifth outer diameter D5 of the insert ramp 170. Thus, when the tube assembly 100 is assembled, the insert ramp 170 interferingly and sealably fits into the receiving ramp 174 and the second outer shoulder 176 abuts the second inner shoulder 172.

FIGS. 3, 4, and 5 illustrate embodiments featuring an outwardly extending radial seal. It should be understood that, in some embodiments, a similar radial seal operating under the same principles as the radial seal of FIGS. 3, 4, and 5 may extend inwardly. Such embodiments featuring an inwardly extending radial seal will be explained below in conjunction with FIGS. 8, 9, and 10. In other embodiments, a radial seal (or portions thereof) may be positioned on both an inwardly facing surface and an outwardly facing surface.

Figure 7:
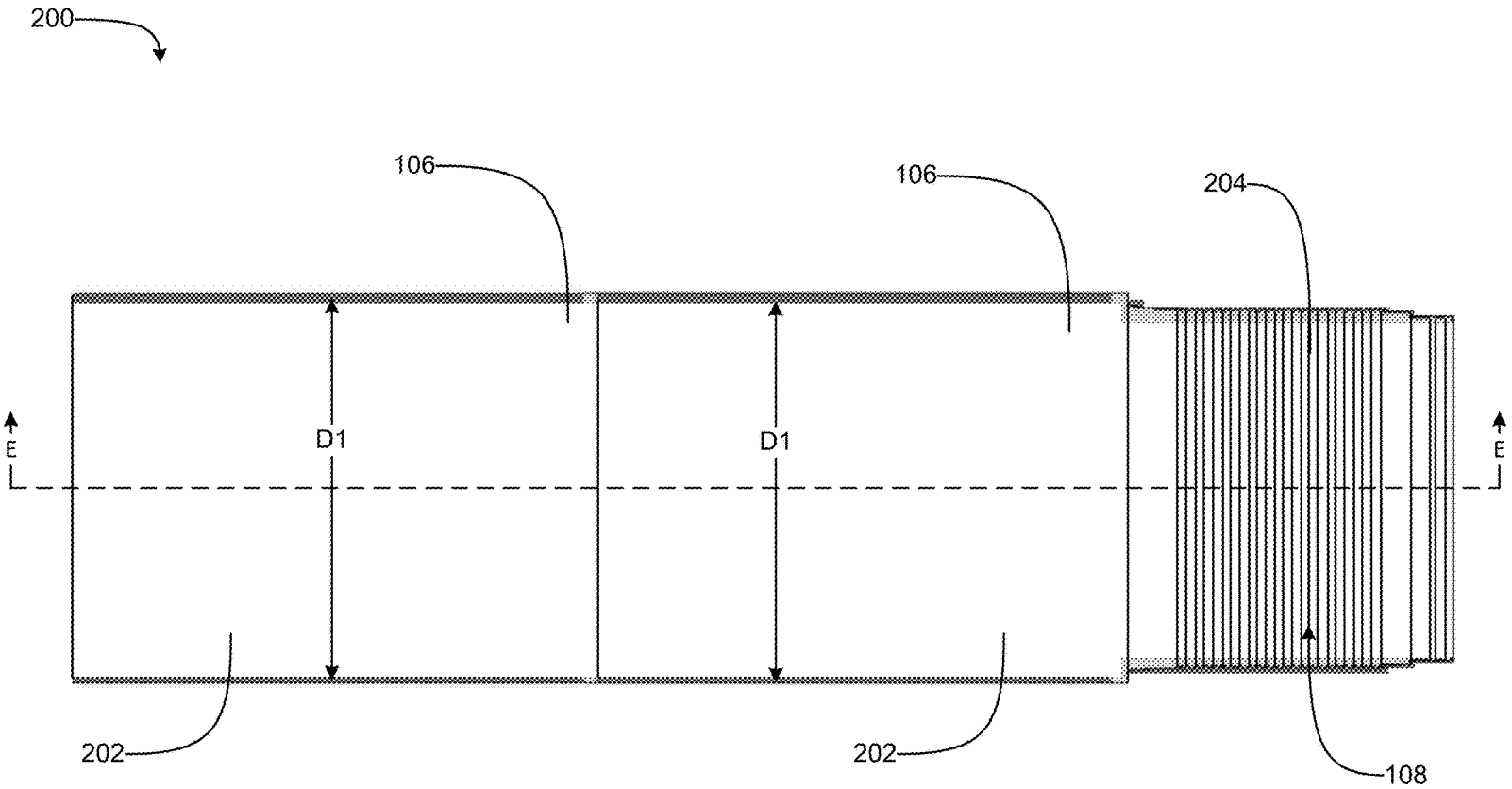
FIG. 7 is a side view of a tube assembly, according to another embodiment.

FIG. 7, illustrates a tube assembly 200 according to an embodiment. The tube assembly 200 includes a plurality of tube sections 202 connected to one another. In some embodiments, the tube sections 202, and thus the tube assembly 200, are substantially circular in cross-section. Each tube section 202 includes an inner connector 204 extending from a body portion 206. The inner connector 204 includes the outer threads 108. Further, each tube section 202 defines a first outer diameter D1 along the body portion 206.

Figure 8:
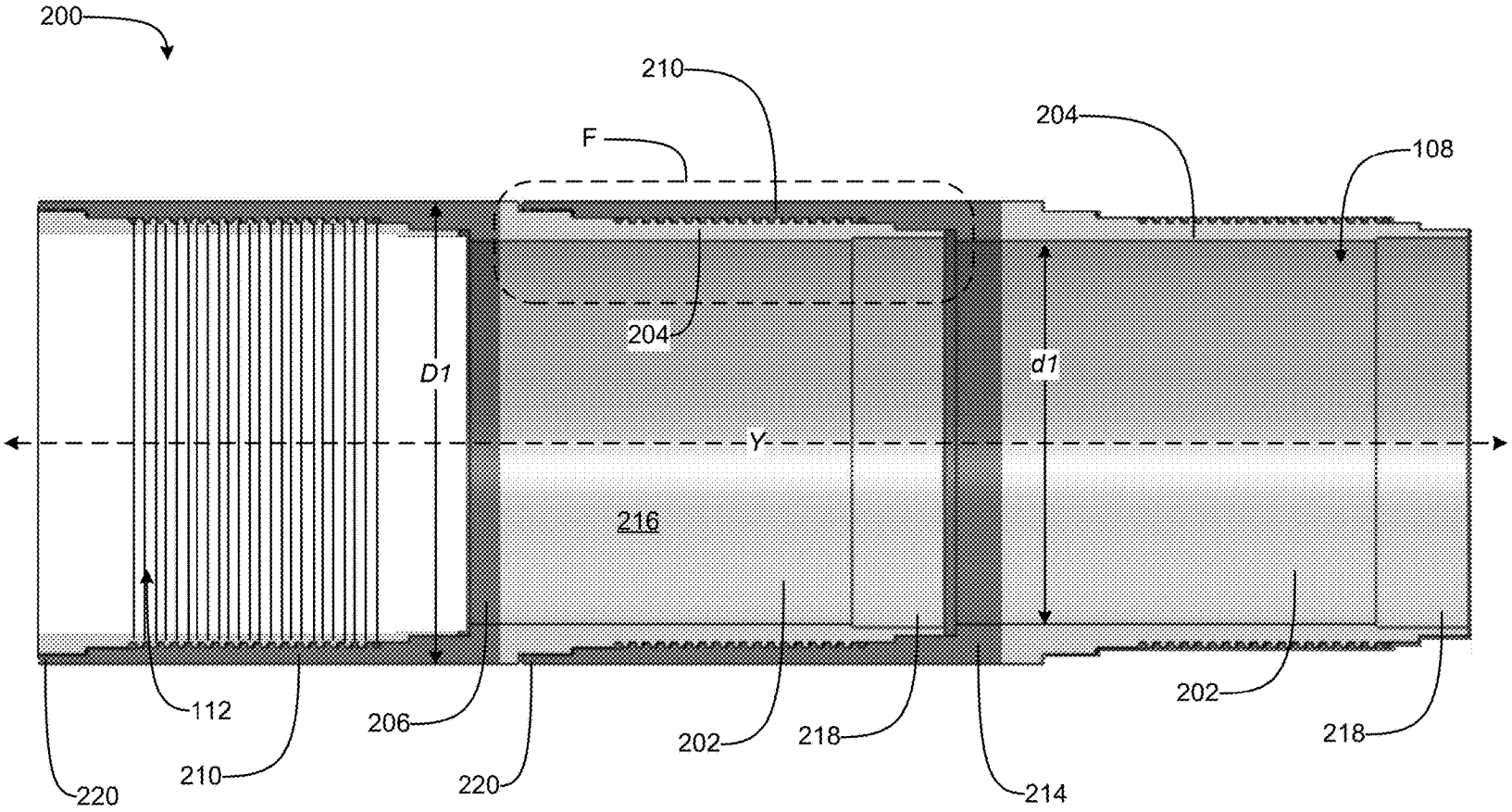
FIG. 8 is a cross-sectional view of the tube assembly of FIG. 7 taken along line E-E of FIG. 6.

FIG. 8 illustrates two neighboring tube sections 202 connected to one another. Each tube section 202, and thus the tube assembly 200, defines an axis Y. Each tube section 202 includes an outer connector 210 extending from the body portion 206. The outer connector 210 includes the inner threads 112. Thus, the tube sections 202 are threadably connectable with one another. More specifically, the inner connector 204 of one tube section 202 is threadably received by the outer connector 210 of the adjacent tube section 202. Each tube section 202 may include a generally cylindrical wall 214 having a wall thickness that varies along a length of the inner connector 204, the body portion 206, and the outer connector 210. Thus, the cylindrical wall 214 forms the features of the inner connector 204, the body portion 206, and the outer connector 210. More specifically, each tube section 202 defines a first inner diameter d1 along the body portion 206. Further, each tube section 202, and thus the tube assembly 200, provides a passageway 216 through which fluids may flow.

Referring again to FIG. 8, rephrased, each tube section 202 has a first end 218 and a second end 220. The inner connector 204 terminates at the first end 218. Similarly, the outer connector 210 terminates at the second end 220. When neighboring tube sections 202 are connected, the first end 218 of one tube section 202 is received by the second end 220 of an adjacent tube section 202. More precisely, the inner connector 204 of one tube section 202 is enveloped by the outer connector 210 of the neighboring tube section 202.

Figure 9:
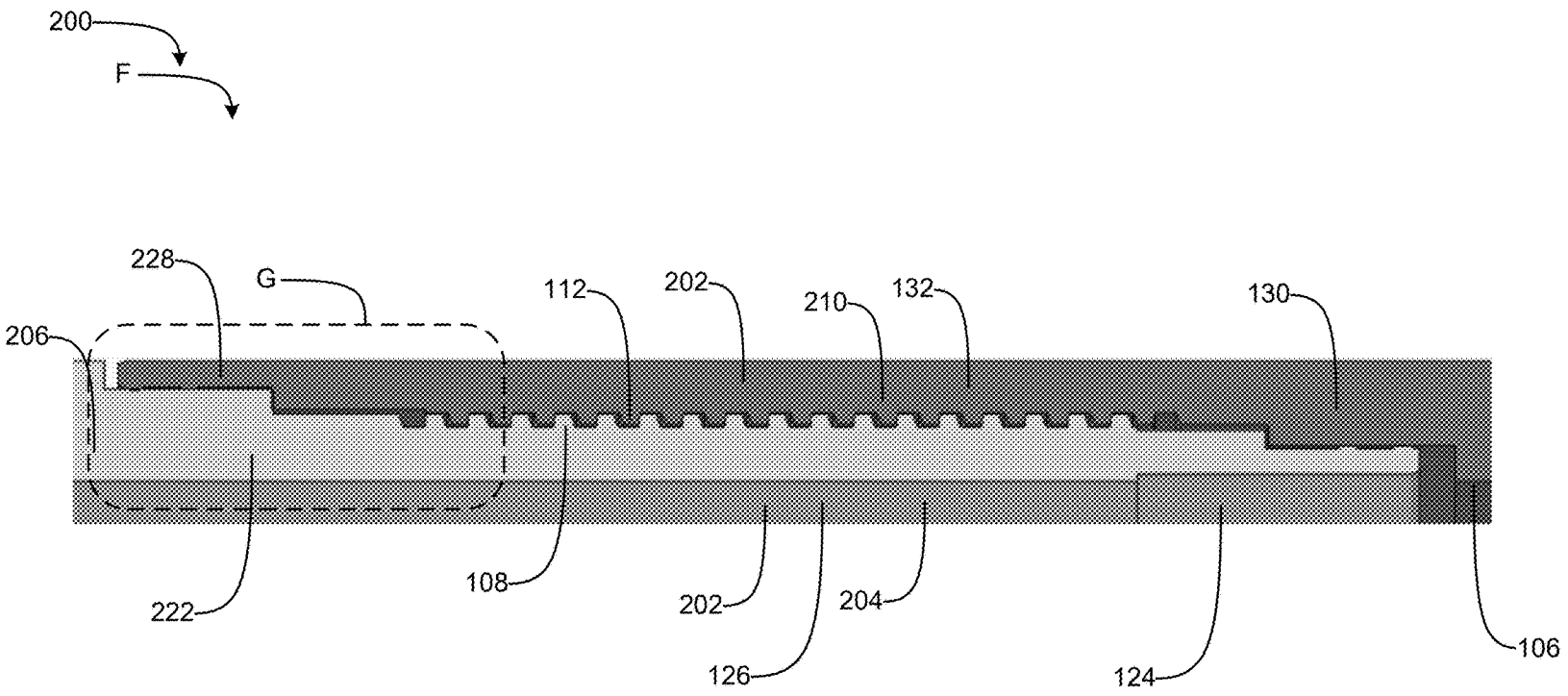
FIG. 9 is an enlarged cross-sectional view of the tube assembly of FIG. 7 taken from region F of FIG. 8.

Referring to FIG. 9, the inner connector 204 has a first inner sealing region 222 and the second inner sealing region 124 extending from the inner threaded region 126. The first inner sealing region 222 is connected to the body portion 206. Similarly, the outer connector 210 has a first outer sealing region 228 and the second outer sealing region 130 extending from the outer threaded region 132. The second outer sealing region 130 is connected to the body portion 206. In operation, the first inner sealing region 222 of one tube section 102 is received by and sealably engages the first outer sealing region 228 of the adjacent tube section 202. Further, in operation, the second inner sealing region 124 of one tube section 102 is received by and sealably engages the second outer sealing region 130 of the adjacent tube section 202. Additionally, in operation, the inner threaded region 126 of one tube section 102 is threadably received by the outer threaded region 132 of the adjacent tube section 202. Further, the tube sections 202 sealably and removably engage with one another. It should be appreciated that sealing engagement between the tube sections 202 may be reproduced should the tube sections 202 be disassembled and reassembled. Thus, the tube sections 202 are reusable.

Figure 10:
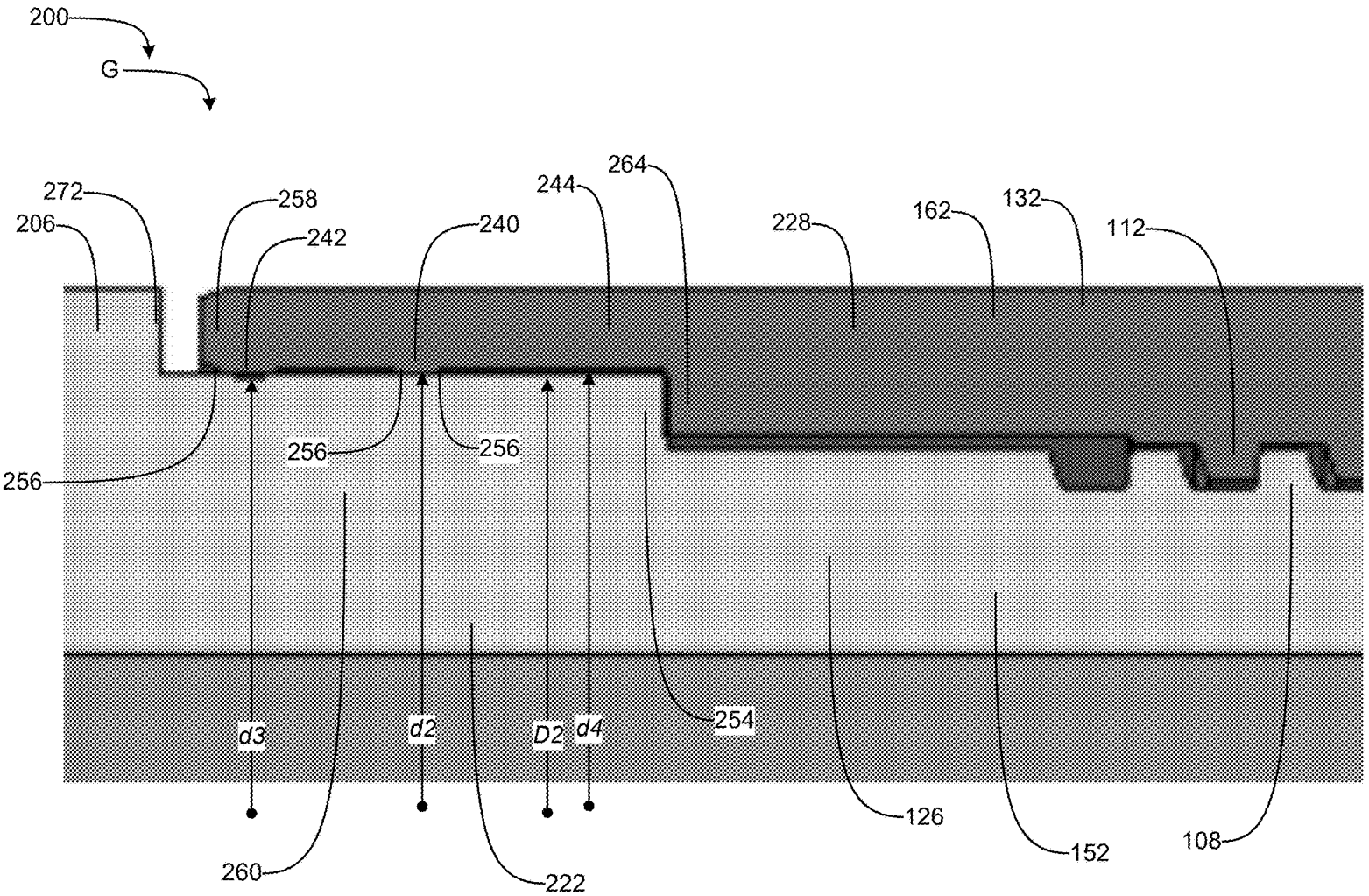
FIG. 10 is an enlarged cross-sectional view of the tube assembly of FIG. 7 taken from region G of FIG. 9.

Looking at FIG. 10, the first outer sealing region 228 includes a support nib 240 and a sealing nib 242 extending radially outwardly from a pin 244. The support nib 240 and the sealing nib 242 respectively define a second inner diameter d2 and a third inner diameter d3. Additionally, the pin 244 defines a fourth inner diameter d4. The third inner diameter d3 is less than the second inner diameter d2. The fourth inner diameter d4 is greater than the second inner diameter d2 and the third inner diameter d3. Thus, the sealing nib 242 extends further radially inwardly from the pin 244 than the support nib 240. The pin 244 extends axially from the outer shank 162 of the outer threaded region 132. The pin 244 is thinner in wall thickness than the outer shank 162 and thus forms a first outer shoulder 264 with the outer shank 162. The support nib 240, the sealing nib 242, and/or the pin 244 have lead-in features 256 (e.g., a chamfer, a radius, a round-over, etc.). In some embodiments, the pin 244 is outwardly chamfered and/or radiused. Additionally, the sealing nib 242 is located at an end 258 of the pin 244 and the support nib 240 is located medially along the pin 244.

Remaining with FIG. 10, the first inner sealing region 222 includes an expansion collar 260 connected axially to the body portion 206 and the inner shank 152 of the inner threaded region 126. The expansion collar 260 may have a wall thickness that is greater than the inner shank 152 and provide a first inner shoulder 254 with the inner shank 152. In some embodiments, the first inner shoulder 254 is chamfered, radiused, and/or otherwise eased to insert past the sealing nib 242. Further, the expansion collar 260 may have a wall thickness that is less than the body portion 206 and provide a second inner shoulder 272 with the body portion 206. When the tube assembly 200 is assembled, the outer threads 108 and the inner threads 112 threadably engage and tighten. Further, the expansion collar 260 defines a second outer diameter D2. The third inner diameter d3 is smaller than the second outer diameter D2. Thus, when the tube assembly 200 is assembled, the sealing nib 242 interferingly and sealably fits over the expansion collar 260. In some instances, the second inner diameter d2 is smaller than the second outer diameter D2. Thus, in such instances, when the tube assembly 200 is assembled, the support nib 240 interferingly and sealably fits over the expansion collar 260. Further, the fourth inner diameter d4 is greater than the second outer diameter D2. In some embodiments, the pin 244 slidably engages the expansion collar 260. Moreover, the expansion collar 260 expands the first outer sealing region 228. Thus, the pin 244 bends radially outwardly via expansion by the expansion collar 260.

Referring generally to FIGS. 2-10, it should be understood and appreciated that any of the features of the tube assembly 100 and/or the tube assembly 200 (e.g., the tube section 102, the outer threads 108, the inner threads 112, the support nib 140, the sealing nib 142, the insert ramp 170, the receiving ramp 174, the outer threads 208, the inner threads 212, the support nib 240, the sealing nib 242, etc.) may be formed in whole or in part using additive manufacturing (e.g., binder jetting, directed energy deposition, material extrusion, powder bed fusion, sheet lamination, vat polymerization, wire arc additive manufacturing, etc.). In some instances, features initially formed using additive manufacturing may be refined to desired tolerances by machining, sanding, cutting, etc.

In other embodiments, other configurations are possible. For example, those of skill in the art will recognize, according to the principles and concepts disclosed herein, that various combinations, sub-combinations, and substitutions of the components discussed above can provide improved threaded connector assemblies.

The above description of the disclosed exemplary embodiments is provided to enable any person skilled in the art to make or use one or more aspects of the disclosure. Various modifications to these embodiments will be readily apparent to those skilled in the art, and the generic principles defined herein may be applied to other embodiments without departing from the spirit or scope of the disclosure. Thus, the disclosure is not intended to be limited to the embodiments shown herein but is to be accorded the widest scope consistent with the principles and novel features disclosed herein.

What is claimed is:

1. A sealed coupling for connecting a first section and a second section of a well system, the well system extending along an axis, the sealed coupling comprising:
   - a first threaded portion positioned on the first section;
   - a second threaded portion positioned on the second section, the second threaded portion engaging the first threaded portion; and
   - a sealing nib positioned on one of the first section and the second section, the sealing nib configured to protrude in a radial direction relative to the axis to engage a surface of the other of the first section and the second section, wherein the sealing nib is configured to interferingly and sealably fit into a compression collar of the other of the first section and the second section, wherein the one of the first section and the second section bends inwardly under compression from the compression collar, and wherein the first threaded portion terminates at an inner shoulder and the inner shoulder abuts the compression collar.

2. The sealed coupling of claim 1, further comprising a support nib positioned on the one of the first section and the second section, the support nib configured to protrude in the radial direction relative to the axis to engage a surface of the other of the first section and the second section.

3. The sealed coupling of claim 2, wherein the sealing nib extends radially further than the support nib.

4. The sealed coupling of claim 2, wherein the sealing nib is located between the support nib and an end of the one of the first section and the second section.

5. The sealed coupling of claim 1, wherein the one of the first section and the second section includes a taper collar connected to a support collar and a tip collar.

6. The sealed coupling of claim 5, wherein the support collar has a wall thickness that is greater than a wall thickness of the tip collar.

7. The sealed coupling of claim 5, wherein the taper collar is inwardly partially conical.

8. The sealed coupling of claim 1, wherein the compression collar has an inner diameter, a portion of the one of the first section and the second section adjacent the sealing nib has an outer diameter, and the outer diameter is smaller than the inner diameter.

9. The sealed coupling of claim 1, further comprising a support nib, wherein the compression collar has an inner diameter, the sealing nib has a first outer diameter, the support nib has a second outer diameter, and the inner diameter is smaller than the first outer diameter.

10. The sealed coupling of claim 1, wherein the first section expands the second section in a radially outward direction.

11. The sealed coupling of claim 1, wherein at least one of the first section, the second section, and the sealing nib has a lead-in feature.

12. A well system comprising:

a first tube section extending along a longitudinal axis, the first tube section including,
- a first end,
- a second end,
- a first threaded portion positioned proximate the first end,
- a support nib protruding radially outwardly relative to the longitudinal axis, and
- a sealing nib positioned proximate the first end, the sealing nib protruding radially outwardly relative to the longitudinal axis, wherein the sealing nib is located between the support nib and the first end of the first tube section;

a second tube section coupled to the first tube section, the second tube section including,
- a first end,
- a second end, and
- a collar positioned proximate the second end of the second tube section, the collar engaging the sealing nib in an interference fit, and the collar engaging the support nib.

13. The well system of claim 12, wherein the sealing nib extends radially further than the support nib.

14. The well system of claim 12, wherein the first threaded portion terminates at an inner shoulder and the inner shoulder abuts an end of the collar.

* * * * *